United States Patent [19]

Uttscheid

[11] Patent Number: 4,924,776

[45] Date of Patent: May 15, 1990

[54] SWITCH FOR A FLOOR TRANSPORTATION SYSTEM

[76] Inventor: Georg Uttscheid, Madronstrasse 17, D-8200 Rosenheim, Fed. Rep. of Germany

[21] Appl. No.: 262,460

[22] Filed: Oct. 25, 1988

[30] Foreign Application Priority Data

Oct. 30, 1987 [DE] Fed. Rep. of Germany ..... 37368869

[51] Int. Cl.[5] ..... E01B 25/28; B65G 43/00; B61L 5/06; B60M 7/00

[52] U.S. Cl. ..... 104/130; 104/195; 246/265

[58] Field of Search ..... 104/130, 195; 246/265

[56] References Cited

U.S. PATENT DOCUMENTS

| | | | |
|---|---|---|---|
| 3,946,974 | 3/1976 | Stiefel et al. | 104/130 X |
| 4,658,731 | 4/1987 | Schumann | 104/130 |

FOREIGN PATENT DOCUMENTS

| | | | |
|---|---|---|---|
| 3404805 | 8/1985 | Fed. Rep. of Germany . | |
| 1283136 | 3/1961 | France | 104/130 |
| 483836 | 3/1972 | U.S.S.R. | 104/130 |
| 84/04289 | 11/1984 | World Int. Prop. O. | 104/130 |

*Primary Examiner*—Andres Kashnikow
*Assistant Examiner*—Mathew C. Graham
*Attorney, Agent, or Firm*—Cahill, Sutton & Thomas

[57] ABSTRACT

A switch for a floor transportation system is described, whereby a guide rail is provided below the floor level. A guide pin extends into this guide rail. In front of this guide pin, a guide shoe of ferromagnetic material is pivotally provided. In the area of the switch, the side walls of the guide rail are provided with electromagnets which pull the guide shoe toward the one or the other wall area so that the guide shoe and the guide pin can be directed into one or the other branch rail of a guide rail fork.

3 Claims, 1 Drawing Sheet

SWITCH FOR A FLOOR TRANSPORTATION SYSTEM

The invention refers to a switch for a floor transportation system with an automotive electric transportation vehicle having a guide pin extending into a guide rail below the floor level and being connected with a steering mechanism of the vehicle. Such a floor transportation system is known from German patent application 34 04 805.

The known floor transportation system is faced with the problem of controlling the course in the area of a branching of the guide rail. Here, the electric transportation vehicle is to be moved selectively and by remote control into one or the other branch guide rail. The present invention solves this problem by means of an electromagnetic switch.

The electromagnetic switch according to the present invention comprises electromagnets in the side walls facing the branching points of the guide rails below the floor level. These electromagnets are selectively and alternatively excitable. In front of the guide pin, a guide shoe is attached pivotally which consists at least partly of a ferromagnetic material.

The invention will now be discussed with reference to the drawings.

Figure 3:
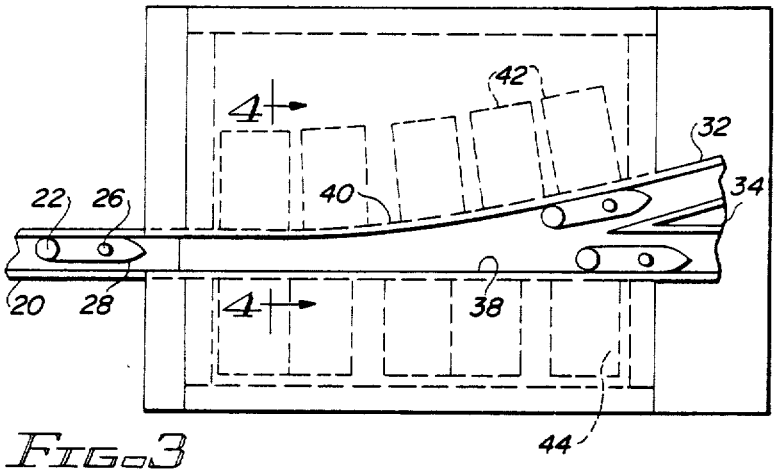
FIG. 3 shows a top view of a switch area of the guide rails of the floor transportation system.
Figure 1:
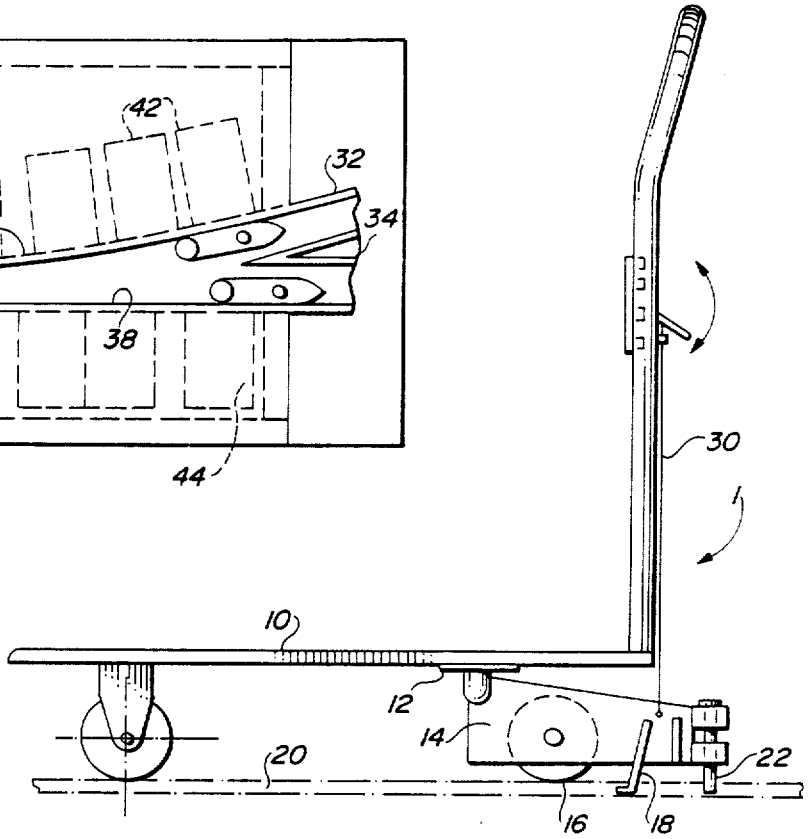
FIG. 1 (PRIOR ART)
FIG. 1 shows a side view of a conventional electric transportation vehicle for a floor transportation system.
Figure 2:
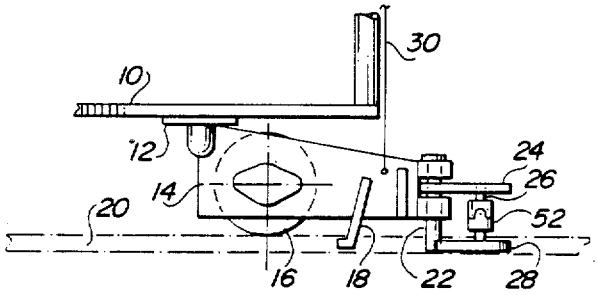
FIG. 2 shows a portion of the electric transportation vehicle of FIG. 1 with modifications in accordance with the present invention.
Figure 5:
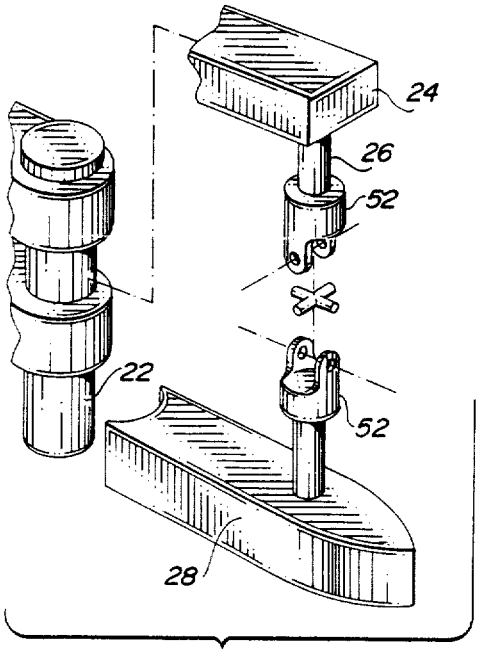
FIG. 5 is an exploded perspective view of a guide shoe support of the invention.

The conventional electric transportation vehicle shown in FIG. 1 has already been described in detail in German patent application 34 04 805. It comprises a platform for carrying the goods to be transported. This platform 10 carries in its front area a turntable 12 which is rotatable about a verticle axis. A steering arm 14 extends forward from this turntable. It carries a front wheel 16. The axis of the front wheel 16 is directly connected with an electric motor (not shown). Further, a current collector 18 is attached to this steering arm 14. The current collector 18 engages a contact rail within a guide rail 20 below the floor level. The front end of the steering arm 14 carries a guide pin 22 which also extends into the guide rail 20. In the improved system illustrated in FIG. 2, a cantilever arm 24 is pivotally connected to the front end of the steering arm 14. It has a shaft 26 which extends from its front end downward. A guide shoe 28 is pivotably connected to the lower end of this shaft 26. This guide shoe 28 has an extended shape like a boat, as shown in FIG. 3. The guide shoe 28 consists either completely or at least partly of iron or another ferromagnetic material so that it can be attracted by an electromagnet. At its front end, the guide shoe 28 has a tip. The shaft 26 is connected with the center of the guide shoe 28 and the guide shoe extends backward approximately to the guide pin 22. The steering arm 14 can be lifted by means of a lifting device 30 so that the current collector 18, the guide pin 22 and the guide shoe 28 can be pulled out of the guide rail below the floor level.

Figure 4:
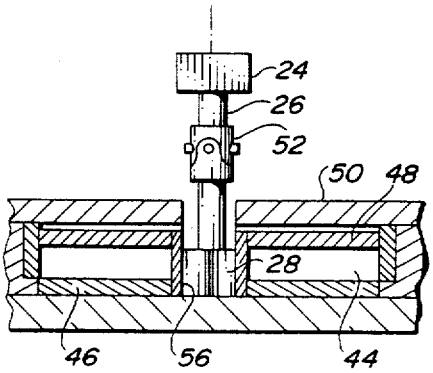
FIG. 4 shows a cross-section along line IV—IV of FIG. 3.

FIG. 3 shows the switch area of the guide rail 20 below the floor level. The switch is provided in the area of a branching point or fork, whereby a branch rail 32 branches from the guide rail 20 toward the right side. The direction of movement is assumed to run from the right to the left. The left side wall of the guide rail (seen in the direction of movement) is a continuous straight side wall. The right side wall of the guide rail 20 has a curvature in the area of the switch. The curved area continues at both ends into a straight wall area. A wedge-shaped element 34 is provided behind the switch. It defines the two additional side walls behind the fork. Several electromagnets 42 are provided one behind the other at both side walls of the switch area 36, i.e. at the straight side wall 38 and at the curved side wall 40. The electromagnets 42 are connected with a power supply and control device. Each electromagnet consists of a magnetic core 44 and a coil 46. The magnetic core extends to the side wall so that the magnetic pole is in the side wall. An insulating layer 48 is provided above the coil and a cover plate 50 is provided above the insulating layer. FIG. 4 shows that a further joint 52 is provided within the vertical shaft 26 of the guide shoe 28, which has a horizontal joint axis so that the guide shoe is pivotable in all directions.

The operation of the switch shall now be described. If an electric transportation vehicle approaches the switch area, the electromagnets of the one side or the electromagnets of the other side are selectively excited. It is now assumed that the upper electromagnets in FIG. 3, i.e. those at the curved side wall of the switch, are excited. As soon as the guide shoe 28 of magnetic material comes into the range of attraction of the electromagnets, it engages the side wall. In the area of the side wall, the electromagnets can be exposed. It is, however, preferred that a cover plate 56 of non-magnetic material is provided. In the latter case, the guide shoe 28 engages and slides along this plate 56. This subjects the steering arm 14 to a torque so that it is pivoted together with the guide pin 22. This pivotal motion occurs in the course of the forward movement of the electric transportation vehicle. Finally, the guide shoe reaches the end of the switch and enters with its tip into the fork rail 32. This causes also the guide pin 22 to move into the fork guide rail. In the further course of the movement, this fork guide rail 32 takes over the guiding function so that the stirring arm 14 is pivoted further. After the guide shoe 28 has left the switch area, the electromagnets are turned off. The sequentially arranged electromagnets 42 can all be excited simultaneously. They also can be excited one after the other. If the electric transportation vehicle is supposed to move in the straight direction, the electromagnets 42 shown in FIG. 3 are excited. The guide shoe 28 now engages the straight inner wall of the switch area and the electric transportation vehicle maintains its straight travelling direction.

I claim:

1. In a switching system for an automotive electric floor transportation system, a vehicle, a guide rail beneath the level of the floor, said guide rail having a switch area for alternatively guiding said vehicle along one or the other of two paths of movement, a steering mechanism on the vehicle having a guide pin engageable with said guide rail, said steering mechanism further comprising a guide shoe comprised at least in part of ferromagnetic material, said guide shoe being positioned in advance of said guide pin and being pivotally mounted on a central vertical shaft, and electromagnets positioned along side said guide rail in said switch area, said electromagnets being selectively energizable to attract said guide shoes to direct said vehicle over one or the other of said two paths of movement.

2. The switching system of claim 1 further characterized in that said guide shoe is mounted for pivotal movement about at least one horizontal axis.

3. The switching system of claim 2 further characterized in that the mounting for said guide shoe includes a universal joint in said vertical shaft providing pivotal motion for said guide shoe about two horizontal axes.

* * * * *